United States Patent [19]

Nilsson

[11] Patent Number: 4,547,988

[45] Date of Patent: Oct. 22, 1985

[54] FIREARM SYSTEM WITH CYLINDER BOLT MECHANISM

[76] Inventor: Lennart C. O. Nilsson, Armfeldtsvägen 9, S-670 40 Ämotfors, Sweden

[21] Appl. No.: 514,815

[22] PCT Filed: Dec. 11, 1981

[86] PCT No.: PCT/SE81/00368

§ 371 Date: Jun. 17, 1983

§ 102(e) Date: Jun. 17, 1983

[87] PCT Pub. No.: WO83/02153

PCT Pub. Date: Jun. 23, 1983

[51] Int. Cl.[4] ..... F41C 11/00; F41C 21/12

[52] U.S. Cl. ..... 42/16; 42/15 B

[58] Field of Search ..... 42/16, 75 B; 89/188

[56] References Cited

U.S. PATENT DOCUMENTS

| | | | |
|---|---|---|---|
| 1,124,071 | 1/1915 | Stamm | 42/16 |
| 1,155,326 | 9/1915 | Stamm | 42/16 |
| 1,234,783 | 7/1917 | Mauser | 42/75 B |
| 1,568,635 | 1/1926 | Speer | 42/16 |
| 3,027,672 | 4/1962 | Sullivan | 42/16 |
| 3,653,140 | 4/1972 | Alday | 42/16 |
| 3,710,492 | 1/1973 | Tirrell | 42/16 |
| 3,742,638 | 7/1973 | Archer | 42/16 |
| 4,154,142 | 5/1979 | Schwegler | 89/185 |
| 4,454,672 | 6/1984 | Timari | 42/16 |

FOREIGN PATENT DOCUMENTS

| | | |
|---|---|---|
| 1703549 | 8/1972 | Fed. Rep. of Germany . |
| 748 | 2/1886 | Sweden . |
| 84429 | 12/1895 | Sweden . |
| 135870 | 1/1903 | Sweden . |

*Primary Examiner*—Charles T. Jordan
*Assistant Examiner*—Ted L. Parr
*Attorney, Agent, or Firm*—Murray, Whisenhunt and Ferguson

[57] ABSTRACT

In a firearm with a cylinder bolt mechanism, a locking chamber (27) is arranged in a space in the barrel between the rear end of the barrel and the rear end of the cartridge chamber for a bolt tip (28) on the bolt. Behind the locking chamber in the barrel is arranged a separate locking ring (23) between a stop (25) in the receiver and the rear end of the barrel. The locking ring is provided with lugs and grooves, and the bolt head is provided with corresponding claws which are able to pass through the grooves in the locking ring and to be rotated into the locked position ahead of the lugs in the ring. By introducing the bolt complete with the bolt head into the barrel and locking it securely in this position, it is possible to achieve greater accuracy because the bolt head acts as a stiffening connection between the barrel and the receiver, so that these components of the firearm are unable to move relative to each other as the result of oscillations in the barrel when the cartridge detonates.

The rotation of the bolt head may be produced by the axial movement of a bolt handle, whereby the rotational motion is achieved by causing the bolt handle to interact with a spiral groove in a bolt head, of which the bolt tip constitutes a front part. Alternatively, the rotational motion may be achieved by turning the bolt handle upwards and into recess in the bolt body, at the same time as the mainspring is tensioned by sliding between lock lugs arranged for this purpose.

11 Claims, 15 Drawing Figures

FIREARM SYSTEM WITH CYLINDER BOLT MECHANISM

TECHNICAL FIELD

The present invention relates to a firearm system with a cylinder bolt mechanism consisting of a bolt and a receiver together with a cartridge chamber in the firearm barrel which is screwed securely into the fore-end of the receiver.

DESCRIPTION OF THE PRIOR ART

The overwhelming majority of existing target rifles and hunting rifles is based on the hundred-year-old Mauser system or on modifications of it. The repeater action requires the mainspring to be tensioned by a final rotational movement of the bolt handle. The cartridge chamber in the classic design is in the form of a counterbore in the rear end of the barrel, and the bolt tip is brought into contact with the end of the barrel, whereby locking takes place between the locking lugs on the bolt tip and the recesses in the receiver.

This classic firearm system exhibits a large number of outstanding characteristics, such as high reliability, robust construction and comparatively uncomplicated manufacture, etc., which has also made this the predominant firearm system for more than one hundred years. Nevertheless, it has been a known fact for a long time that the locking arrangement should lie as close as possible to the centre of the explosion in order to achieve the highest accuracy. It has also been suggested that the locking system should be situated inside the barrel itself, whereby the cartridge chamber would have to be advanced slightly further into the barrel. Those designs which have been proposed were, however, so complicated to manufacture that no production was set up on a commercial scale.

Simplifications to the bolt handle action have also been suggested. One avenue of development abandoned the rotating repeater action entirely and proposed a rectilinear action in its place, this being the so-called straight-pull-action. An early design is specified, for instance, in Swedish Pat. No. 748, published in 1886. This Patent emphasizes the fundamental advantage of the rectilinear bolt handle action over the prevalent, rotating bolt handle action: the high rate of repeat fire achieved because the hand does not need to be rotated and because the rifle does not need to be lowered from the shoulder. This also offers the potential for greater accuracy, whether in the area of target shooting or hunting. The mechanism specified in SE No. 748 was, however, technically highly imperfect and was unable to prevent the field of technical developments from being dominated by mechanisms based on the Mauser system and other similar systems which utilize a rotating bolt handle action. A large number of designs of cylinder mechanisms with a rectilinear bolt handle action have been introduced over the years. Thus, German Patent Specification No. 84 429 published in 1894 describes a cylinder mechanism with a bolt exhibiting front locking lugs or claws so arranged as to be capable of being introduced into a locking chamber in the receiver for the purpose of locking the mechanism in the locking chamber after the bolt has been rotated with the help of threads on the bolt. In German Patent Specification No. 135 970 published in 1900 this principle was developed further. The bolt is now equipped with a moving bolt head. The locking chamber is still arranged inside the receiver, however. This means, amongst other things, that the manufacturing process is more complicated. The rest of the design of the mechanism also presents major manufacturing problems, and yet the Patent Specification fails to suggest any complete solution to the problem. The picture would be complicated even further by several functions, such as an effective safety function and protection against bursting of the casing, etc., which are not provided for. In spite of its great potential, this type of mechanism did not achieve any success, apparently because no design was offered which combined the outstanding technical performance with adequate manufacturing economy.

A different avenue of development retained the rotational bolt handle action, but designed the system in such a way that the rotation can take place with the bolt remaining stationary in the axial sense. However, existing firearms with a stationary bolt have the locking arrangement to the rear in the form of hinged wings in the rear part of the bolt body. This must be regarded as a technically expedient solution, since it is well known that the greatest accuracy is achieved when the locking arrangement is situated close to the centre of the explosion.

DISCLOSURE OF THE INVENTION

The principal object of this invention is to provide a firearm system which gives the firearm very great accuracy. The increased accuracy is achieved in this case principally by situating the cartridge chamber a certain distance into the barrel from the rear edge of the barrel, and by situating the locking mechanism adjacent to it.

It is another object of this invention, in accordance with one embodiment of the invention, to provide a firearm system which offers a rectilinear repeater action—the straight-pull-action.

It is a further object of this invention, in accordance with another embodiment of the invention, to provide a firearm system where the bolt handle is rotated with the bolt body remaining stationary in combination with locking in the foremost part of the mechanism.

It is still another object of this invention to provide a firearm system in which outstanding technical performance can be combined with good manufacturing economy.

These and other objects of the invention can be achieved by arranging the rear end of the cartridge chamber at a certain distance from the rear end of the barrel, by arranging in the space in the barrel between the rear end of the barrel and the rear end of the cartridge chamber a locking chamber for a rotatable bolt tip which forms part of the bolt, and by arranging behind the locking chamber in the barrel a separate locking ring between a stop in the receiver and a stop on the barrel.

Other objects and advantages and characteristic features of the present invention will become apparent from the following description of a couple of preferred embodiments.

BRIEF DESCRIPTION OF THE DRAWINGS

In the following description of a couple of preferred embodiments reference will be made to the accompanying drawings, in which:

FIGS. 1–9 illustrate a first preferred embodiment of the invention, in which:

FIG. 1 is a side view of the mechanism in accordance with the embodiment together with certain other component parts of the firearm, which are shown for the purpose of illustrating the function of the mechanism;

FIG. 2 shows a longitudinal section through the receiver;

FIG. 3 provides an axial section through the bolt;

FIG. 4 provides a perspective view of a locking ring included in the mechanism;

FIG. 5 shows a section V—V in FIG. 2;

FIG. 6 shows a section VI—VI in FIG. 2;

FIG. 7 provides a perspective view of a guide sleeve;

FIG. 9 shows a section IX—IX in FIG. 2 illustrating the bolt handle and the bolt handle rail of the bolt;

FIGS. 10–13 illustrate a bolt included in a mechanism in accordance with a second preferred embodiment of the invention, in which FIG. 10 shows a perspective view of the bolt in accordance with said second embodiment;

FIG. 11 shows a side view of a unit consisting of a bolt head, a firing pin arrangement and a firing pin nut which is an integral part of and capable of moving inside the bolt body;

FIG. 12 is a view from above showing the firing pin nut with the firing pin arrangement in the cocked position ready for firing;

FIG. 13 shows a bolt handle with its connecting foot.

DESCRIPTION OF THE PREFERRED EMBODIMENTS

Figure 1:
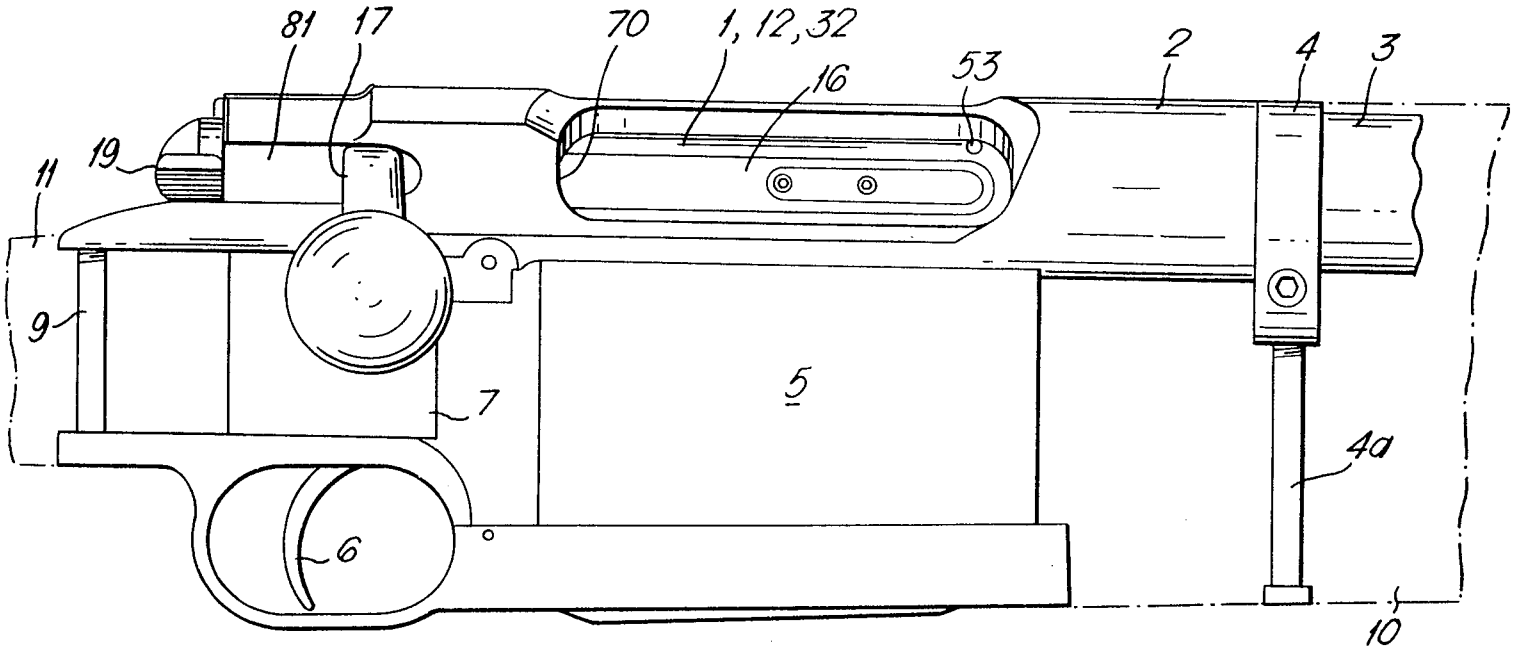

The firearm system illustrated in FIG. 1 comprises a bolt 1 and a receiver 2. The rifle barrel is identified by the reference 3, a recoil lug 4 with a front guard screw 4*a*, a cartridge magazine 5, a trigger 6, a trigger guard 7 with a sear 8 (FIG. 2), and a rear guard screw 9. In FIG. 1 dotted lines are also used to indicate a stock 10 and a butt 11.

Figure 3:
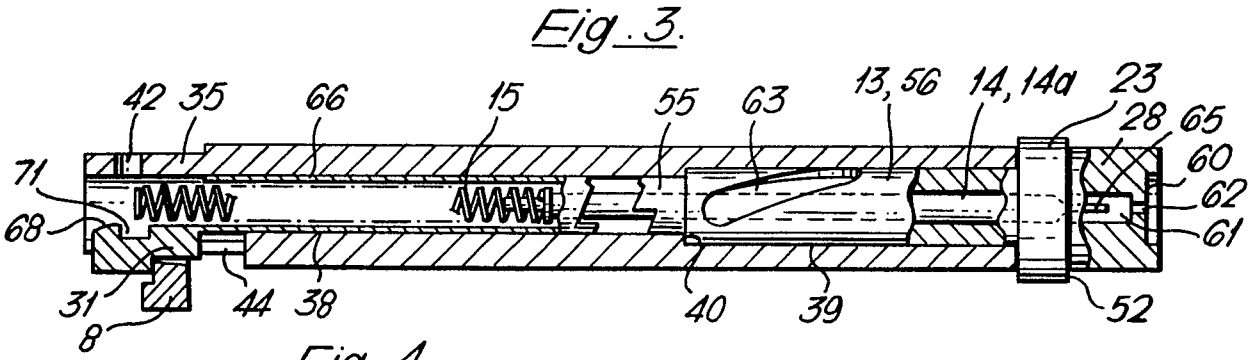

The bolt 1 comprises the following principal components: a bolt body 12 (FIG. 3), with moving inside it a bolt head 13, a firing pin 14 with a mainspring 15, a bolt handle rail 16 with a bolt handle 17 moving on the outside of the bolt body 12, and a guide sleeve 18 (FIG. 7) with a safety catch 19.

The receiver 2 has a smooth, circular inside with a groove 70 for the bolt handle rail 16 milled into the receiver. The diameter of the inside of the receiver 2 is larger at the front, whereby the thus widened bore exhibits right at the front a threaded part 20 for the purpose of screwing the barrel 3 securely to the receiver 2. The widened part then continues further into the receiver 2 as a cylindrical part referred to as the receiver bore 21. The receiver bore 21 has a smooth, cylindrical inside and a depth or length such that, with the barrel screwed in to its full extent, it is capable of accommodating not only a rear cylindrical part 22 of the barrel having an external diameter corresponding to that of the receiver bore 21, but also a locking ring 23 between the rear edge 24 or the stop on the barrel 3 and a stop 25 inside the receiver which forms the bottom of the receiver bore 21. The space for the locking ring 23 between the stop 25 in the receiver and the stop (the edge 24) on the barrel 3 has been identified by the reference 26.

The rear, cylindrical part 22 of the barrel 3 has a central bore referred to as the locking chamber 27. The locking chamber 27 has a diameter corresponding to the external diameter of a tip 28 on the bolt head 13 which is able to rotate inside the locking chamber. The locking chamber 27 also has a length corresponding to the length of said tip 28 plus an allowance for a so-called 'head-space' so as to permit sufficient clearance to be provided for the maximum and minimum positions of cartridges. The stop in the bottom of the locking chamber 27 has been identified by the reference 29. The cartridge chamber 54 is arranged ahead of the locking chamber 27 in the barrel 3.

In addition to the description of the receiver 2, mention must also be made of the fact that in the rear, lower part of the receiver are arranged a groove 30 for a tensioning tooth 31, an ejector opening 32 in the side of the receiver (FIG. 1 and FIG. 6), and an ejector and bolt stop of a previously disclosed type arranged on the opposite side of the receiver. Also, the upper, rear part of the receiver has a recess 33 for a guide lug 34 on the guide sleeve 18 having the same length and width as the recess 33, a bolt handle groove 81 and a magazine opening 45 in the bottom of the receiver.

Figure 7:
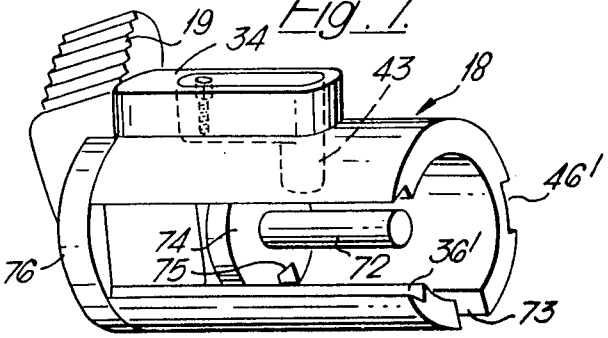

The various component parts of the bolt 1 will now be described in greater detail. The bolt body 12 (FIG. 3) is in the form of a cylinder. Its rear part is in the form of a pin 35 of smaller diameter so arranged as to be capable of being introduced into the guide sleeve 18 (FIG. 7). On one side, corresponding to the right-hand side of the firearm, is a dovetail-shaped grooved track 36 for the bolt handle rail 16 (FIG. 9), which extends from the rear edge of the bolt body as far as the base of the groove 37. A transcurrent bore passes through the bolt body 12, whereby the rear part 38 of the bore extends to a point somewhat ahead of the mid-point of the body. The bore then continues as a front part 39 which terminates at the front end of the bolt body. The stop between the front 39 and the rear 38 part of the bore has been identified by the reference 40. Through the wall of the bolt body extends a transcurrent continuous opening 41 between the front part 39 of the bore and the grooved track 36 from the bottom of the groove 37 rearwards until it is on a level with the stop 40. In order to connect the bolt body 12 to the guide sleeve 18, the rear pin is provided with a hole 42 to accommodate a locking pin 43 in the guide sleeve 18 (FIG. 7). The rear pin 35 on the bolt body 12 also has in its lower wall a transcurrent slot 44 for the tensioning tooth 31, said slot extending for the length of the pin 35. On the outside of the bolt body, on the opposite side in relation to the grooved track 36, is a groove 46 (FIG. 6) for the cartridge case ejector (not shown) and the bolt stop. A pin 47 (FIG. 6), of which the purpose is to lock the bolt head 13 securely in the axial sense relative to the bolt body 12, is screwed securely to the bolt body and extends radially inwards in a groove 48 shaped in the form of a sector of a circle in the bolt head 13. A gas expansion hole 53 extends through the wall of the bolt body from the front part 39 of the bore and terminates in the area of the ejector opening 32.

Figure 4:
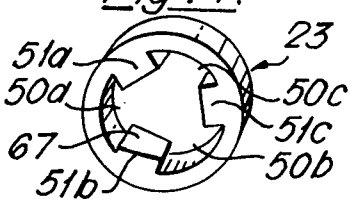
Figure 5:
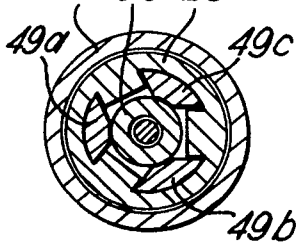

Right at the front the bolt body 12 exhibits three claws 49*a–c* (FIG. 5), so arranged as to be guided by the engagement of the claws into three corersponding claw grooves 50*a–c* between three radially arranged lugs 51*a–c* in the ring 23 (FIG. 4) for the purpose of locking the ring 23 securely in the position determined by the bolt body. The axial length of the claws 49*a–c* agrees with a very high degree of accuracy with the axial length of the ring 23. When the bolt body 12 with the claws 49*a–c* is introduced to its maximum extent into the ring 23, the front edge of the claws will then be in line with the front side 52 (FIG. 3) of the ring. The lug 51*b* in the ring 23, which lies closest to the magazine 5, is provided with a sliding surface 67 to facilitate the feeding in of the cartridges into the cartridge chamber 54.

The bolt head 13 (FIG. 8*a*) comprises a stud 55, a bolt neck 56 and the aforementioned bolt tip 28. All these cylindrical components share the same axis, which is also common to the bolt body 12, the locking ring 23 and firing pin 14. The stud 55 and the bolt neck 56 have external diameters which allow the bolt head 13 to be a running fit and to rotate freely in the front 39 and rear 38 part of the bore through the bolt body. The bolt neck 56 is in contact with the stop 40 in said bore. The bolt tip 28 has, as has already been mentioned, essentially the same length as the depth of the locking chamber 27 in the barrel 3. The tip 28 also exhibits for its entire length three longitudinal claws 58*a–c* having the same cross-section as the claws 49*a–c* on the bolt body 12. The claw 58*a* (FIG. 8*a*) is equipped with a cartridge ejector 59. The supporting bottom is identified by the reference 60 in FIG. 3. Through the bolt head 13 extends a bore 61 for the firing pin 14 with a front constriction 62 for the point 65 of the firing pin.

Figure 6:
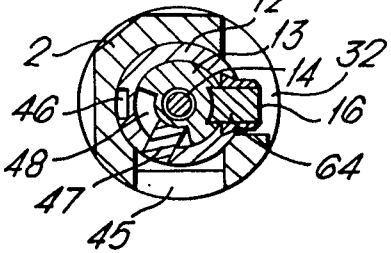
Figure 9:
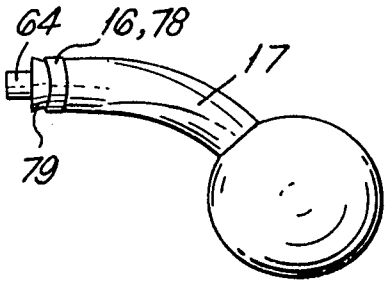

The sleeve of the bolt neck 56 exhibits a spiral groove 63 on the side which corresponds to the right-hand side of the firearm, so arranged as to accommodate a pivot pin 64 at the front end of the bolt handle rail 16 (FIG. 9). The spiral groove 63 has an axial length which corresponds to the length of the opening 41 in the side of the bolt body 12. The sector of the circle over which the spiral groove 63 extends amounts to 60°. The bolt neck 56 also exhibits the aforementioned groove 48 in the form of the sector of a circle which does not extend in an axial sense (FIG. 6). Finally, the bolt neck 56 has a transcurrent gas expansion hole 53*a* which is a prolongation of the hole 53 in the bolt body when the holes are directly in line with each other, as is the case when the bolt head 13 is rotated through 60° in a clockwise direction (with reference to FIG. 6). In the case of defective cartridges being used, resulting in penetration of the percussion cap, the gas pressure from the cartridge produced when the firing pin 14 is thrown back by the pressure may be led away through the vents 53*a*, 53 so that the gases will be blown out through the ejector opening 32. Of course, the gas pressure may also be led away downwards and into the magazine by arranging the vents 53*a*, 53 to face straight down.

The stud 55 on the bolt bolt head 13 is provided at its rear end with notches and projections, the shape and function of which will be explained in the description of the method of operation of the firearm system.

The firing pin 14 comprises the actual firing pin 14*a* with its point 65 and a firing pin tube 66 having the same external diameter as the stud 55 on the bolt head and forming a rearward prolongation of it in the bore 38 in the bolt body 12. The actual firing pin 14*a* is screwed securely into the tube 66 which then corresponds to the firing pin nut in conventional firearm systems. A mainspring 15 is arranged inside the tube 66. Right at the back the firing pin 14 exhibits a lug 68 on the tensioning tooth 31, which is in engagement with the sear 8 of the firearm and is able in a previously disclosed manner to be moved downwards for firing with the help of the trigger 6. A safety groove ahead of the lug 68 has been identified by the reference 71.

The guide sleeve 18, which in the assembled firearm system passes over the rear pin 35 on the bolt body 12 and is secured to it with the help of the inward-facing radial pin 43 which is screwed securely in place after assembly, exhibits on its right-hand side a dovetail-shaped groove 36' which forms a prolongation of the dovetail-shaped groove 36 in the bolt body 12. On the opposite side is a prolongation 46' of the groove 46 for the ejector mechanism. A guide pin for the mainspring has been identified by the reference 72, and a groove in the bottom of the guide sleeve for the tensioning tooth 8 has been identified by the reference 73. Inside the guide sleeve is a safety disc 74 with an activation groove 75 which interacts with the safety groove 71 and the lug 68 of the firing pin. The safety disc 74 is rotated by the safety catch 19 which is of the flag type and forms part of the rear rotatable end-piece 76 of the guide sleeve. The mechanism can, of course, be fitted in place of the flag-type safety device with a side safety device of the type traditionally fitted to hunting rifles. On the upper side of the guide sleeve the aforementioned guide lug 34 interacts with the aforementioned recess 33 on the rear part of the receiver.

Of the various component parts of the firearm system, all that now remains to be described in greater detail is the bolt handle rail 16. The bolt handle rail 16 has a length which corresponds to the overall length of the grooved tracks 36' and 36 in the guide sleeve and the bolt body from the front side of the safety catch 19 to the bottom 37 of the grooved track 36 in the bolt body. The part of the rail behind the handle 17—the cocking piece 78—lacks the dovetail and is capable of being moved backwards to the fully extended position shown in FIG. 2, when the firearm is not in the safe mode, whereas the safety catch 19 in its safe position as shown in FIG. 1 will prevent the firearm from being capable of being opened by blocking the rearward movement of the cocking piece 78 past the rear end-piece 76 of the guide sleeve. Along the rest of its length, the bolt handle rail 16 exhibits a dovetail 79 which interacts with the dovetail-shaped grooves 36, 36', which act as a guide for the bolt handle rail in the bolt body and the guide sleeve. Right at the front the bolt handle rail exhibits the aforementioned radially inward-facing pivot pin 64 which forms part of the pivot pin holder 80, which is let in and is screwed securely in place after the bolt handle rail has been introduced into the dovetail-shaped groove 36 as far as the position shown in FIG. 2. According to the same principles, the pin 47 is fitted to the bolt body and the pin 43 to the guide sleeve.

The method of operation of the firearm system specified above will now be explained. The initial position for a repeat cycle is assumed to be one with the cartridge chamber 4 empty and with the bolt drawn back to its maximum extent to an end position determined by the bolt stop (not shown) which in this position is in contact with a stop for the bolt stop in the groove 46 (FIG. 6) in the bolt body. The safety catch 19 is moved into a position in which it is not in the safe mode (pointing upwards) and the bolt handle rail 16 is moved into its rearmost position so that the cocking piece 78 will have moved past the rear end-piece 76 of the guide sleeve. The extent to which the bolt handle rail can be moved backwards is limited on the one hand by the rear end of the dovetail 79 which, with the bolt handle rail in its rearmost position, will come up against the rotatable end-piece 76 of the guide sleeve, and on the other hand by the pivot pin 64 which will make contact with the rear end of the spiral groove 63 in the bolt head.

Figure 8A:
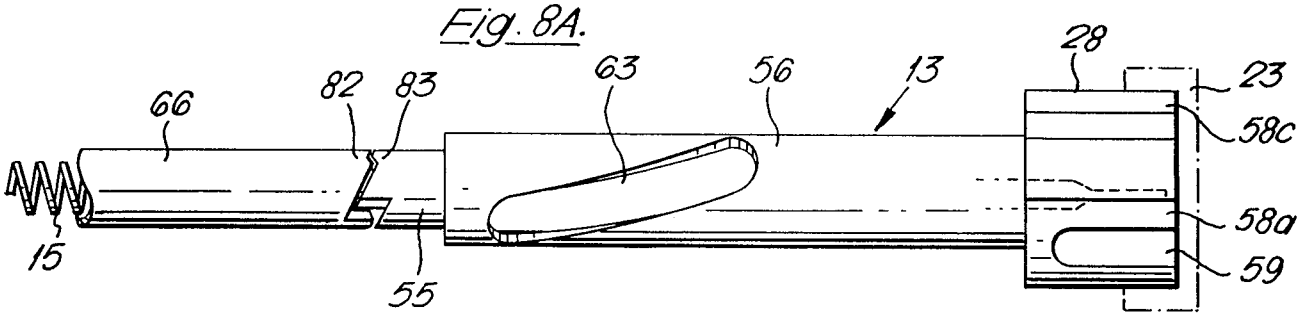
FIGS. 8*a–c* shows a bolt head included in the bolt together with the front parts of the firing pin at different moments.

With the help of the bolt handle 77 the bolt 1 is now moved forwards into the receiver 2, whereby a cartridge will begin to be fed into the cartridge chamber 54 from the magazine 5. The bolt handle rail 16 slides in the groove in the wall of the receiver 2 but is at that moment stationary relative to the bolt body. Towards the end of this phase of the cycle the tensioning tooth 31 slides into the groove 30 in the bottom of the receiver and the guide lug 34 on the guide sleeve 18 begins to slide into the recess 33 in the rear upper edge of the receiver. During this phase of the action the firing pin tube 66 is in contact with the stud 55 on the bolt head 13 in the manner illustrated in FIG. 8*a*. A notch and a tooth on the firing pin tube 66, identified jointly by the reference 82, are then in engagement with a corresponding tooth and notch 83 on the stud 55, said details acting as a means of preventing the bolt head from rotating when they are in engagement with each other. At the same time the rotation stop ensures that the firing pin is not advanced to its maximum extent relative to the bolt head, whereby the point 65 of the firing pin will lie at a certain depth below the supporting bottom 60 whilst the cartridge is being fed into the receiver. This phase is terminated by the tensioning tooth 31 engaging with the sear 8. The guide lug 34 will at this point have been introduced about half-way into the groove 33. The bolt tip 28 will have been introduced as far as the front edges of its claws 58*a–c* into the claw grooves 50*a–c* in the ring 23 (FIG. 8*a*).

As the bolt is now moved further into the receiver 2 with the help of the bolt handle, the mainspring 67 will be compressed by the firing pin 13 being forced through the engagement of the tensioning tooth 31 with the sear 8. The stud 55 on the bolt head will begin to slide away from the firing pin tube 66. In other respects there will be no other relative movement at this point between the various component parts of the bolt. The ring 23 will prevent the bolt head 13 from rotating for as long as the claws 58*a–c* are in engagement with the claw grooves 50*a–c*. The ring 23 thus assumes the function of the teeth/notches 82/83 as a rotation stop. At the same time the claws 49*a–c* on the bolt body are introduced into the claw grooves 50*a–c* in the ring 23 and prevent it from rotating in the space 26 in the barrel 3 (provided that the ring 23 is also securely held in its position between the stop 25 and the rear edge 24 of the barrel). This will also mean that the bolt handle rail 16 is still stationary and locked in position relative to the bolt body 12.

Figure 2:
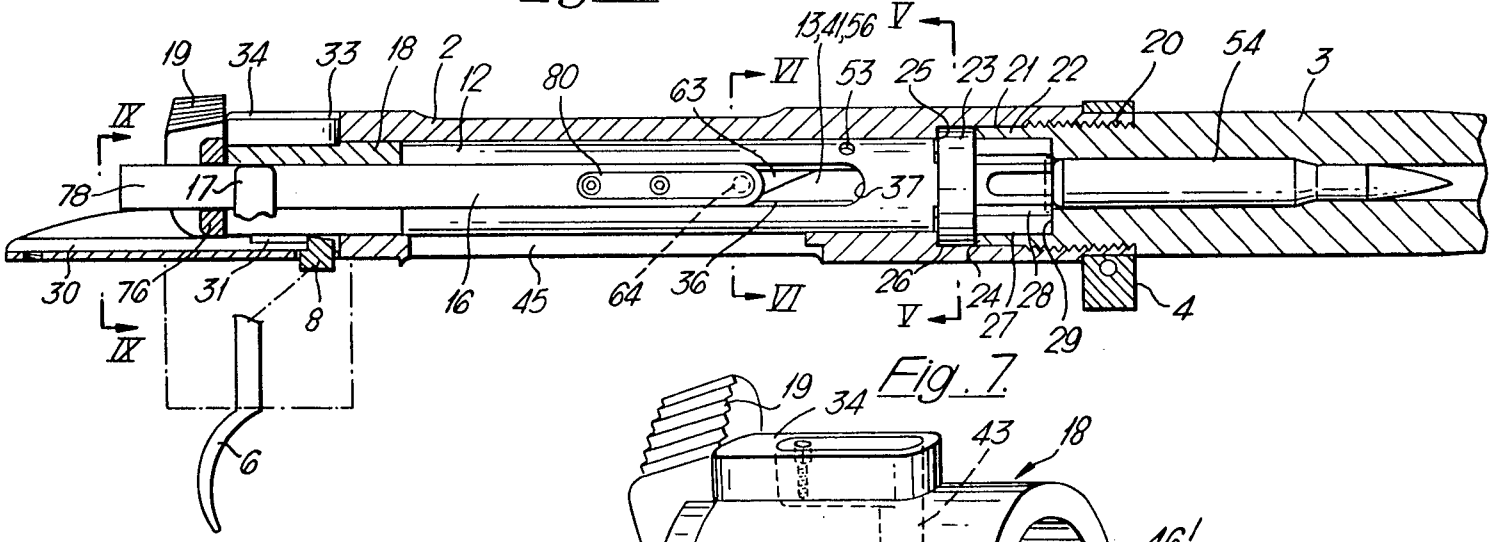
Figure 8B:
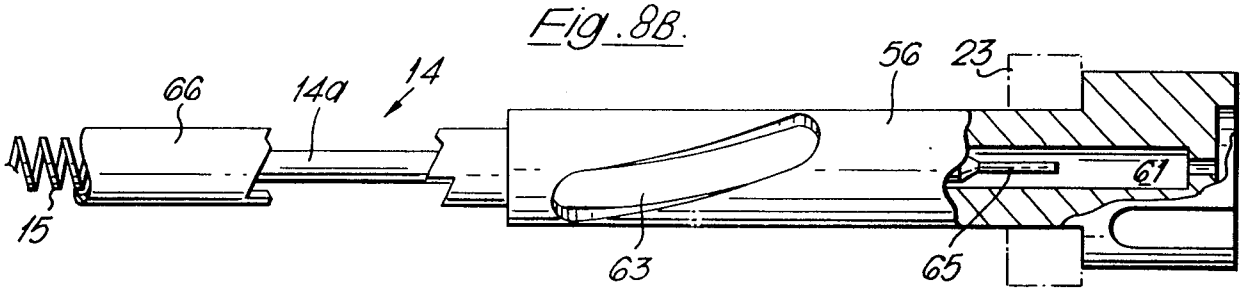
Figure 8C:
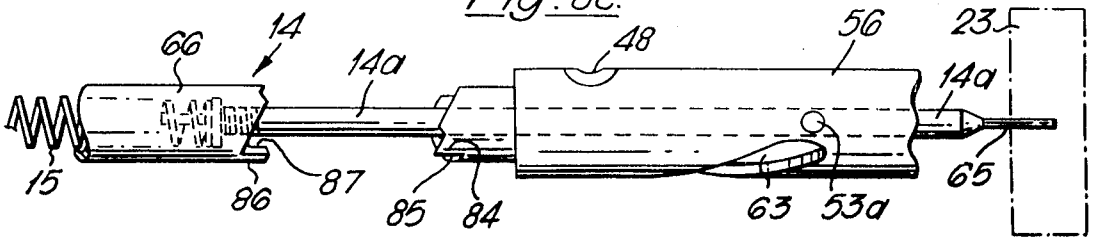

As soon as the bolt tip 28 has passed the ring 23, however, the bolt tip will be free to begin to rotate. This moment (of course, the movement of the bolt handle takes place continuously without interruption between the different phases) is illustrated in FIG. 2 and in FIG. 8*b*. The mainspring 15 is now fully compressed. The cartridge will have been introduced fully into the cartridge chamber 54. The bolt tip will have been moved to its maximum extent towards the stop 29 in the locking chamber 27, and the guide lug 34 on the guide sleeve will have been introduced to its maximum extent into the groove 33, so that the bolt 1 cannot be moved any further into the receiver. At that moment, when the bolt head 13 is free in relation to the ring 23, the bolt handle rail 16 can be moved forwards in the grooved track 36, 36' until the bolt handle rail 16 comes up against the bottom of the groove 37. The interaction of the pivot pin 64 of the bolt handle rail and the spiral groove 63 in the bolt neck 56 will thus cause the bolt tip to rotate through 60°. At the end of this movement, as shown in FIG. 8*c*, when the bolt handle rail 16 comes up against the bottom 37 and its cocking piece 78 has moved past the end-piece 76 of the guide sleeve, the claws 58*a–c* on the tip 28 will be situated ahead of and will be in contact with the respective lug 51*a–c* on the ring 23. The firearm may now be made safe by folding down the safety catch 19 behind the cocking piece 78 of the bolt handle rail, at the same time as the safety disc 74 runs in the groove 71 in the firing pin.

When the firearm is fired, after having been put out of the safe mode, by means of the trigger 6 which causes the sear 8 to move out of the way, the mainspring will cause the firing pin to move forwards to its maximum extent, so that the large teeth and the bottoms of the teeth 84–87 of the firing pin tube 66 and the stud 55 will engage to the maximum extent. This maximum engagement is deeper than the engagement of the rotation stop shown in FIG. 8*a*, with the result that the tip 65 of the firing pin passes through the constriction 62 and causes the cartridge to detonate. The repeat cycle is then terminated by the bolt being returned to its initial position. The pivot pin 64 now returns the bolt head to its initial position, during which operation the tooth 84 on the stud 55 slides in the bottom of the tooth 87 on the firing pin tube so that in the final phase the rotation stops 82, 83 will again be brought into engagement. Otherwise, the different phases take place in reverse order in an analogous manner to that described above, whereby the cycle is terminated by the spent cartridge case extracted by the cartridge extractor 59 being ejected in the conventional manner. As has already been stated in the description of the present invention, greater accuracy than could be achieved by earlier firearm systems is achieved by, amongst other things, the bolt together with the bolt tip being introduced into the barrel and securely locked ahead of the locking ring. When the cartridge detonates and the bullet is propelled along the bore of the barrel, the barrel will always be subjected to a high level of stress which manifests itself as oscillations in the material. The fact that the tip of the bolt in accordance with the invention is introduced into the barrel at the moment of detonation means that the bolt tip provides a connection between the barrel and the receiver and holds the cartridge securely in place irrespective of any oscillations in the barrel, which is not possible in conventional firearm systems where the only connection between the barrel and the receiver is in the form of a screwed connection between these units.

FIGS. 10–13 illustrate a second preferred embodiment of the invention. The bolt in this case has been identified by the reference 100 and comprises the following principal component parts:

A bolt body 101 with a bolt head 102 (FIG. 11) able to rotate inside it, a firing pin 103 with a mainspring 104, a firing pin point 105 and a firing pin nut 106, a driving nipple 107, a bolt handle 108 and a safety catch 109 arranged on the bolt body 101.

Figure 10:
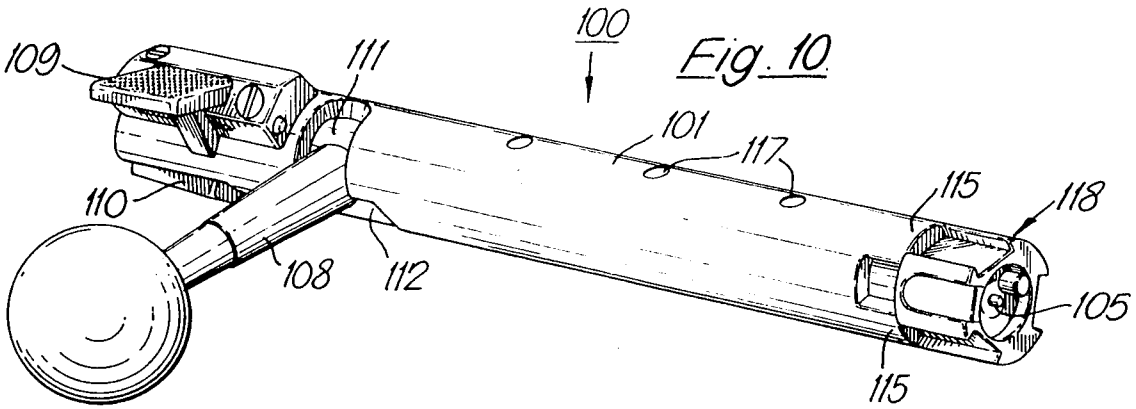
Figure 13:
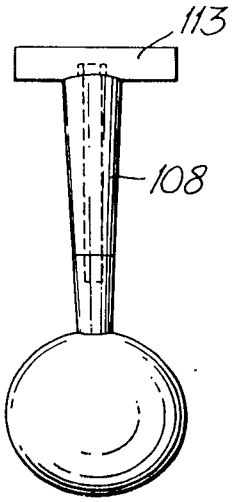

The bolt body 101 consists in accordance with the invention of a cylindrical tube. On the side not visible in FIG. 10 is a longitudinal guide groove for a combined guide lug and locking lug in the receiver (not shown). As in the previous preferred embodiment, the receiver is in the form of a cylindrical bore which in this case has a completely smooth inside except for the aforementioned combined guide lug and locking lug. The front end of the receiver is of identical design to that in the previously described embodiment. This means that the cartridge chamber is arranged at a certain distance into the barrel measured from the rear end of the barrel, besides which a separate locking ring of the same type as that in the previous embodiment is arranged between the rear edge or stop of the barrel and a stop in the receiver which forms the bottom of the receiver bore. In a manner identical to that in the previous embodiment, a locking chamber is also arranged in the rear cylindrical part of the barrel.

At the rear end of the bolt body 101 and in its lower wall is a transcurrent slot for a tensioning tooth 110 on the firing pin nut 106. Through the wall of the bolt body 101 also extends a slot 111 permitting the bolt handle 108 to rotate about a sector of a circle through an angle of about 60°. In conjunction with the opening 111 is also arranged a longitudinal opening 112 for the foot 113 of the bolt handle 108. The bolt body 101 also exhibits three gas expansion holes 114, and right at the front the bolt body 101 also exhibits three claws 115 so arranged that by engagement of the claws they will fit in the three corresponding claw grooves between the three radially inward-facing lugs in the locking ring (not shown), cf. the previous embodiment, for the purpose of locking the ring securely in the position determined by the bolt body 101. When the bolt body 101 with the claws 115 has been introduced to the maximum extent into the ring (not shown) the front edge of the claws will then coincide with the front face of the ring.

The bolt head 102 consists of a tubular bolt neck 116 with gas expansion holes 117, and in the front part a bolt tip 118. The latter has the same design and function as the bolt tip described in conjunction with the previous embodiment and accordingly does not require to be explained in any greater detail here. The rear part of the bolt neck 116 also exhibits a recess 119 for the bolt handle foot 113.

The driving nipple 107 is arranged between the firing pin nut 106 and the mainspring 104. In its front part the driving nipple is provided with threads 120 enabling the driving nipple 107 and the bolt head 102 to be screwed together to form a single unit. When this is to be done, the bolt handle 108 with the bolt handle foot 113 must be removed. The unit which consists of the firing pin 103, the driving nipple 107 and the firing pin nut 106, i.e. those component parts illustrated in FIG. 12 with the exception of the bolt handle 108, is introduced from the rear into the tubular bolt body 101, whereas the bolt head 102 is introduced from the other direction, whereupon the two component parts are screwed fully together so that the groove 119 in the bolt head 102 falls directly in line with a corresponding groove 120 in the driving nipple 107. The grooves 119 and 120 together form a recess having the same shape as the foot 113. The composite groove 119, 120 is moved into a position directly in line with the groove 112 of corresponding shape in the bolt body 101, whereupon the bolt handle foot 113 may be introduced through the groove 112 into the bolt body and securely located in the groove 119, 120 in the thus integrated unit which consists of the bolt head 2 and the driving nipple 107. For the purpose of locating the bolt handle foot 113 in the groove 119, 120 the bolt handle foot 113 is so arranged as to be capable of being expanded in the transverse direction.

The firing pin 103 is screwed securely at its rear end into the firing pin nut 106 and is securely located with the help of a transcurrent spring pin 121.

Figure 11:
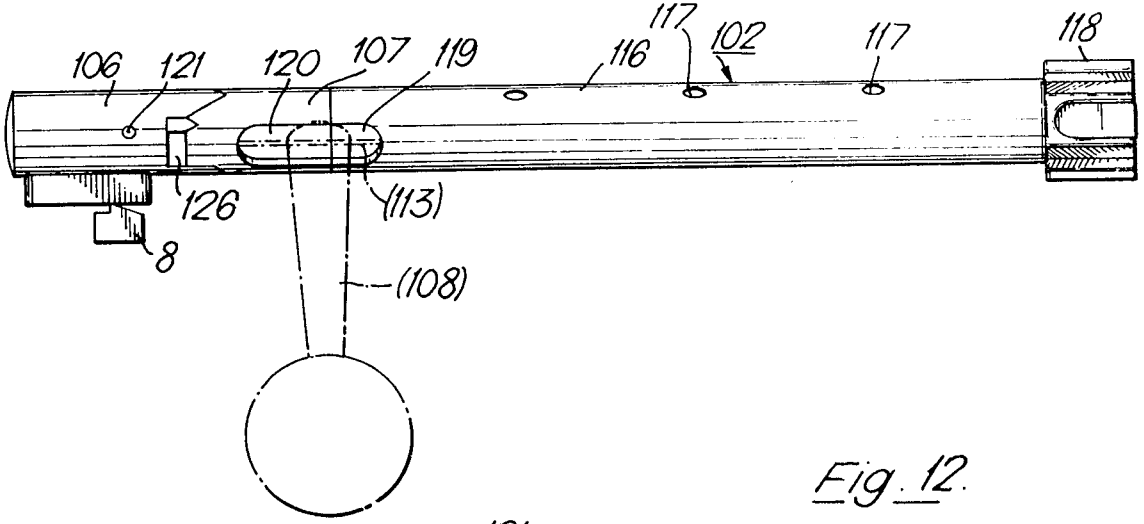
Figure 12:
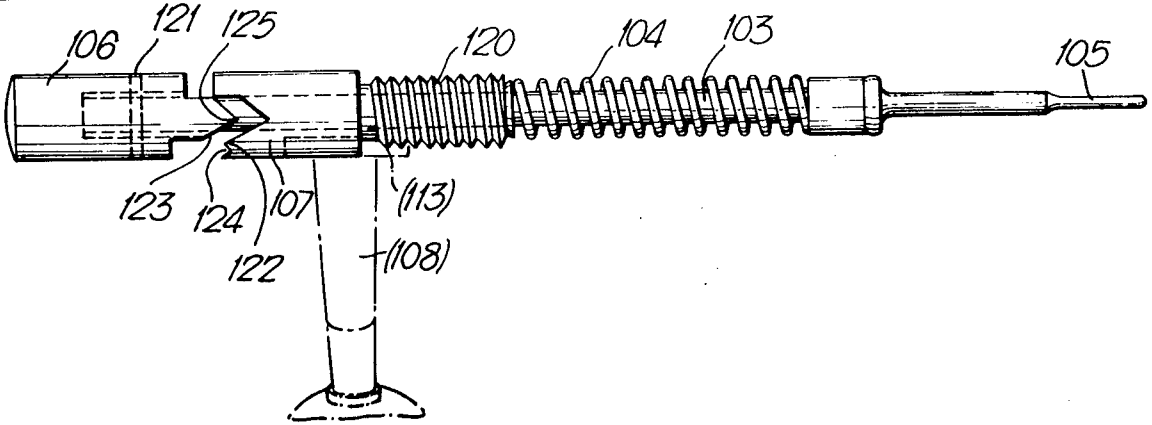

For the purpose of compressing the mainspring 104, when the bolt handle 108 is moved upwards in the groove 111 in the repeater action, the driving nipple 107 and the firing pin nut 106 are provided with two pairs of lock lugs 122 and 123. FIG. 11 shows the position before the repeater action has commenced, and FIG. 12 shows the position of the individual component parts after the repeater action has finished and the bolt handle 108 has been returned down into the locked position in the slot 111. Also present at the end of the lock lugs 122 are locking notches 124 capable of interacting with the point 125 of the firing pin nut 106 for the purpose of locking the firing pin nut 106 and the driving nipple 107 in the tensioned position. Between the driving nipple 107 and the firing pin nut 106 is also a groove 126 to accommodate a safety lug on the safety catch 109.

The method of operation of the mechanism described in conjunction with FIGS. 10–13 agrees with regard to the method of operation of the bolt tip 118 and the associated interacting locking ring (not shown) with the method of operation of the previous embodiment. Thus the description of the function of the present embodiment will concentrate on the method of operation of other component parts of the system. The initial position for a repeat cycle is assumed to be one with the cartridge chamber containing a spent cartridge case, and with the bolt in the locking position, as shown in FIG. 10. The locking ring will then lie behind the bolt tip 118 and will be locked by its flanges to the ears of the bolt tip, at the same time as the ears 115 on the bolt body 101 are introduced into the grooves on the locking ring. As the bolt handle 108 is now moved upwards in the slot 111 in the body 101—the rotating action will describe a sector of a circle of about 60°—the unit consisting of the driving nipple 107 and the bolt head 102 will be caused to rotate about its axis with the help of the bolt handle 108. When the tensioning tooth 110, which lies in the rear groove in the bolt body 101, prevents the firing pin nut 106 from rotating, the lock lugs 122 and 123 will slide towards each other and will force the firing pin nut 106 to move backwards, thereby compressing the mainspring 104, until the sear 8 snaps into place ahead of the tensioning tooth 31 and the point 125 of the firing pin nut 106 snaps into place in the notch 124 on the driving nipple 107. At the same time the bolt tip 118 will have rotated through 60°, enabling it to pass freely through the locking ring when the bolt handle 108 is pulled back. The spent cartridge case will be ejected, whereupon a new cartridge may be fed in. Once the bolt with the bolt tip 118 has reached the end of its travel, the bolt handle 108 may once again be moved downwards, for which purpose a conventional recess for the bolt handle is arranged in the receiver and in the stock. This movement does not call for any force to be applied, since the mainspring will already have been compressed during the initial part of the repeat action when the bolt handle was moved upwards in the slot 111.

During the repeat action the bolt 100 is prevented from being withdrawn from the receiver by the engagement of the bolt lock in one of the locking lugs on the bolt tip. If it is wished to remove the bolt, the bolt handle must be moved downwards through a certain angle until the locking lug on the bolt tip 118 becomes disengaged from the bolt lock.

I claim:

1. A firearm comprising a stock, a barrel having a rear end, a trigger and a cylinder bolt mechanism consisting of a bolt having a front region and a receiver having a front end and a rear end, a cartridge chamber, having a front end and a rear end, in the firearm barrel which is screwed securely into the front end of the receiver, the rear end of the cartridge chamber spaced from the rear end of the barrel and defining a space therebetween, a locking chamber in said space, a rotatable bolt tip on said bolt, said locking chamber receiving said bolt tip, a first stop located on the rear end of the barrel, a second stop located in the receiver rearward of the barrel, a locking ring located rearward of the locking chamber and between said first stop and said second stop, male means and female means for preventing said locking ring from rotating with the bolt tip, said male means at the front region of the bolt, said female means being of matching shape and located in said locking ring, said male means introduced into the female means upon forward movement of the bolt after the bolt tip has passed all the way through said locking ring.

2. Firearm of claim 1, wherein the bolt tip is provided with at least one claw and the locking ring is provided with radially inward-facing lugs and at least one claw groove located between said lugs and of matching shape to said claw so that the bolt tip with its said at least one claw running in said at least one claw groove is capable of being passed through said ring.

3. Firearm of claim 2, wherein said male means consists of at least one claw at the front end of the bolt and said female means consists of at least one claw groove between radially inward facing lugs on the locking ring.

4. Firearm of claim 3, wherein said male means comprises a plurality of claws and said female means comprises a plurality of matching claw grooves.

5. Firearm of claim 2, wherein said bolt tip has a plurality of claws and said locking ring has a plurality of lugs and claw grooves.

6. Firearm of claim 1, including a bolt head, a bolt body, the bolt tip forming the front part of the bolt head, and a tubular bolt neck, said bolt head and bolt neck arranged as to be capable of being rotated inside the bolt body.

7. Firearm of claim 6 further including a bolt handle, rail means connected to said bolt handle for causing rotation of said bolt head in said bolt body, a groove in said receiver, said bolt handle being moveable forwards in at least one groove once the bolt tip has entered the locking chamber, and a radially inward-facing peg means in said bolt head for cooperating with said rail means for causing said rotation.

8. Firearm of claim 6, further including a mainspring, a bolt body groove in said bolt body, bolt handle means for moving in a plane at right angles to the longitudinal axis of the bolt to cause the bolt head to rotate, and for tensioning said mainspring when said bolt handle means is moved upward in said bolt body groove, fixed component means having lock lugs and being unable to move axially in relation to the bolt body, a firing pin, and second component means which is an integral part of said firing pin and capable of axial motion in relation to said fixed component means when said mainspring is being compressed, said bolt handle moving upwards in said bolt body groove by passing between said lock lugs and said second component means.

9. Firearm of claim 8, further including a driving nipple, a firing pin nut, and interacting lock lugs on said driving nipple and said firing pin nut.

10. Firearm of claim 9, further including fastening means for fastening together insaid bolt body the firing pin and associated firing pin nut and driving nipple when introduced from the rear into the bolt body, and the bolt head when introduced into the front of the bolt body, and hole means in said bolt body for permitting passage of said bolt handle to connect to a unit comprising said driving nipple and said bolt head screwed together.

11. The combination of a barrel and a cylinder bolt mechanism for use in a firearm comprising a stock and said combination, said mechanism comprising a bolt having a front region and a receiver having a front end and a rear end, a cartridge chamber, having a front end and a rear end, in said barrel, said barrel securely screwable into the front end of the receiver so that the rear end of the cartridge chamber is spaced from the rear end of the barrel and defines a space therebetween, a locking chamber in said space, a rotatable bolt tip on said bolt, said locking chamber receiving said bolt tip, a first stop located on the rear end of the barrel, a second stop located in the receiver rearward of the barrel, a locking ring located rearward of the locking chamber and between said first stop and said second stop, male means and female means for preventing said locking ring from rotating with the bolt tip, said male means at the front region of the bolt body, said female means being of matching shape and located in said locking ring, said male means introduced into the female means upon forward movement of the bolt after the bolt tip has passed all the way through said locking ring.

* * * * *